US006070135A

United States Patent [19]

Kim et al.

[11] Patent Number: 6,070,135

[45] **Date of Patent: *May 30, 2000**

[54] METHOD AND APPARATUS FOR DISCRIMINATING NON-SOUNDS AND VOICELESS SOUNDS OF SPEECH SIGNALS FROM EACH OTHER

[75] Inventors: Chul Hong Kim; Jum Han Bae, both of Suwon, Rep. of Korea

[73] Assignee: Samsung Electronics Co., Ltd., Kyungki-do, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/695,723

[22] Filed: Aug. 12, 1996

[30] Foreign Application Priority Data

Sep. 30, 1995 [KR] Rep. of Korea ..... 95-33519

[51] Int. Cl.[7] ..... G10L 3/02

[52] U.S. Cl. ..... 704/215

[58] Field of Search ..... 704/207, 208, 704/227, 228, 267, 219, 214, 215, 210

[56] References Cited

U.S. PATENT DOCUMENTS

| | | | |
|---|---|---|---|
| 3,646,576 | 2/1972 | Griggs | 704/275 |
| 4,092,493 | 5/1978 | Rabiner et al. | 704/237 |
| 4,331,837 | 5/1982 | Soumagne | 704/215 |
| 4,376,874 | 3/1983 | Karban et al. | 704/215 |
| 4,435,831 | 3/1984 | Mozer | 704/267 |
| 4,509,186 | 4/1985 | Omura et al. | 704/231 |
| 4,700,391 | 10/1987 | Leslie, Jr. et al. | 704/207 |
| 4,856,068 | 8/1989 | Quatieri, Jr. et al. | 704/227 |
| 5,357,595 | 10/1994 | Sudoh et al. | 704/215 |
| 5,548,680 | 8/1996 | Cellario | 704/219 |
| 5,574,823 | 11/1996 | Hassanein et al. | 704/208 |
| 5,630,012 | 5/1997 | Nishiguichi et al. | 704/207 X |
| 5,649,055 | 7/1997 | Gupta et al. | 704/233 |
| 5,675,639 | 10/1997 | Itani | 704/231 |

FOREIGN PATENT DOCUMENTS 4-168499 6/1992 Japan ..... G10L 3/02

OTHER PUBLICATIONS

Atal et al. A Pattern Recognition Approach to Voiced–Unvoiced–Silence Classification with Applications to Speech Recognition. IEEE Transactions on Acoustics, Speech, and Signal Processing, vol. ASSP–24, No. 3, Jun. 1976.

(List continued on next page.)

*Primary Examiner*—Emanuel Todd Voeltz
*Assistant Examiner*—M. David Sofocleous
*Attorney, Agent, or Firm*—Sughrue, Mion, Zinn, Macpeak & Seas, PLLC

[57] ABSTRACT

A method and apparatus for discriminating non-sounds and voiceless sounds of speech signals, recorded on a recording medium, from each other when playing back the speech signals at a varied play-back speed. The method includes the steps of setting, as a reference voltage level, an optional value between a voltage level corresponding to non-sounds and a voltage level corresponding to voiceless sounds, detecting a pitch component of each waveform of the speech signals, comparing the absolute value of a voltage level of the detected pitch component with the reference voltage level, and distinguishing and outputting a portion of the speech signal associated with the detected pitch component based on the result of the comparison. The apparatus includes a waveform splitter for splitting each waveform of the speech signals at a predetermined time interval, a level modulator for modulating the level of each split speech signal waveform to remove a DC component included in the speech signal waveform, a pitch detector for detecting the voltage level of a pitch component of each modulated speech signal waveform, a comparator for comparing the detected voltage level of the pitch component with a reference voltage level initially set, and a switch for selectively switching each split speech signal waveform on the basis of the result of the comparison.

7 Claims, 4 Drawing Sheets

OTHER PUBLICATIONS

Rabiner et al. Applications of an LPC distance Measure to the Voiced–Unvoiced–Silence Detection Problem. IEEE Transactions on Acoustics, Speech and Signal Processing. vol. ASSP–25, No. 4., Aug. 1977.

Rabiner et al. A Comparative Performance Study of Several Pitch Detection Algorithms. IEEE Transactions on Acoustics, Speech and Signal Processing, vol. ASSP–24, No. 5, Oct. 1976.

Rabiner et al. Fundamentals of Speech Recognition. pp. 14–20, 1993.

METHOD AND APPARATUS FOR DISCRIMINATING NON-SOUNDS AND VOICELESS SOUNDS OF SPEECH SIGNALS FROM EACH OTHER

BACKGROUND OF THE INVENTION

1. Field of the Invention

The present invention relates to a method and apparatus for discriminating and separating non-sounds and voiceless sounds of speech signals from each other so that the length of the non-sound can be modulated without degrading a signal corresponding to the voiceless sound when the speech signals, which have been recorded on a recording medium, are played back at varied speeds.

2. Description of the Related Art

In a conventional apparatus, when speech signals recorded on a recording medium are played back at a varied play-back speed, the tone of the speech sounds different from the original tone due to degradation in the reproduced speech signals resulting from the variation in play-back speed. For example, when the play-back is performed at a high speed, the frequency of speech signal being played back varies from that of the original speech signal. As a result, the speech is typically heard as a "peep-peep" sound. On the other hand, when the recorded speech signals are played back at a low play-back speed, the reproduced speech will typically have a "loosened tape sound".

A conventional method for preventing such phenomenons is described in Japanese Patent Laid-open Publication No. Heisei 4-168499 (Jun. 16, 1992), which discloses a method for partially playing back speech signals that are read into a memory buffer. In accordance with this method, when the play-back speed is doubled, speech signals read by the memory buffer are partially played back in such a manner that only one of two successive time-slices of the speech signals are played back.

For example, when a vocal recording of "I go to school with Jane" is played back at a double speed in accordance with the above-mentioned conventional method, components of the original speech corresponding to the shaded portions shown in FIG. 1 are eliminated, so that only the speech signals "I to with Jane" is reproduced. Since the conventional method plays back only a part of the speech signals at a higher play-back speed so as to maintain the original tone of the speech, the original meaning of the speech is lost. As a result, it is very difficult to understand the original meaning of the recorded speech using the conventional reproduction method and apparatus.

In an attempt to prevent both a loss of speech signals and a degradation in tone from occurring when recorded speech signals are played back at varying speeds, the present inventors have conceived a speed-variable speech signal reproduction apparatus and method as disclosed in Korean Patent Application No. 94-24514, which is entitled "Speed-Variable Audio Play-Back Apparatus".

In order to explain how the length of speech signal is modulated by the above-mentioned speed-variable audio signal play-back apparatus, the basic form of speech signal will first be described with reference to FIG. 2. As illustrated, a waveform of a speech signal consists of various sounds, namely, voiceless sounds, voice sounds and non-sounds, along with noise components. Voice sounds are sounds involving vibrations at the person's vocal organ, and include vowels, nasal sounds and flowing sounds.

On the other hand, voiceless sounds are sounds, such as noise, generated at the point of articulation formed by an articulation organ such as the speaker's tongue, teeth or lips. Generally, voiceless sounds, which are irregularly generated, are indicative of the characteristics of corresponding sounds. On the other hand, voice sounds, which are regularly generated, are indicative of the lengths of corresponding sounds, along with the characteristics of corresponding speech signals.

For example, when a sound "ka" is analyzed, it is determined that that sound consists of two sounds which are simultaneously generated, namely, a voiceless sound corresponding to "k", and a regular voice sound corresponding to "a". Where this sound "ka" is modulated in length, only the number of waveforms corresponding to the voice sound varies, and the voiceless sound is not varied. This will be described in more detail with reference to FIGS. 3A–3C.

As shown in FIG. 3A, the sound "ka" consists of a voiceless sound portion corresponding to "k" and one voice sound waveform corresponding to "a". As shown in FIG. 3B, on the other hand, the sound "ka-" consists of a voiceless sound portion corresponding to "k" and two voice sound waveforms corresponding to "a-". Alternatively, as shown in FIG. 3*c*, the sound "ka--" consists of a voiceless sound portion corresponding to "k" and three voice sound waveforms corresponding to "a--".

As apparent from FIGS. 3A–3C, each of the speech signals consists of a voiceless sound, whose waveform does not vary even when the length of a corresponding speech signal varies, and a voice sound, which has a plurality of the same waveforms, the number of which varying depending on the sound. Accordingly, the speed-variable audio play-back apparatus as proposed by the inventors in the above-referenced Korean patent application operates to play back a speech signal at a varied speed while preventing any degradation in tone and loss of the speech signal by copying or eliminating a part of a plurality of the same waveforms, which correspond to a voice sound of the speech signal, without modulating a voiceless sound of the speech signal.

To reproduce speech signals at a varied play-back speed more effectively, however, it is desirable not only to vary the length of the voice sound of a speech signal, but also to vary the length of the non-sound of the speech signal. However, like non-sounds, voiceless sounds have a very irregular waveform characteristic. That is, non-sounds which include noise components have waveforms substantially similar to those of voiceless sounds.

Accordingly, it is very important to distinguish such voiceless sounds from non-sounds to achieve accurate reproduction of the sound signals at a varied play-back speed. However, it is difficult to distinguish voiceless sounds from non-sounds using conventional methods. For example, if the noise component of the non-sound is determined to be the same as a voiceless sound component, it is impossible to distinguish and thus modulate the non-sound.

On the other hand, when the noise component included in the non-sound has a voltage level higher than a predetermined level, it may be incorrectly recognized as a voiceless sound. Hence, the noise may be processed along with voiceless sounds. As a result, the noise is reproduced along with original sounds in a normal play-back mode or in a speed-varied play-back mode.

SUMMARY OF THE INVENTION

An object of the present invention is to solve the above-mentioned problems by providing a method and apparatus for discriminating non-sounds, which include noise components, from voiceless sounds of speech signals.

In accordance with one embodiment, the present invention provides a method for discriminating non-sounds from voiceless sounds of speech signals recorded on a recording medium, such as a tape or the like, when playing back the speech signals at a varied play-back speed. This method comprises the steps of setting, as a reference voltage level, an optional value between a voltage level corresponding to non-sounds and a voltage level corresponding to voiceless sounds, detecting a pitch component of each waveform of the speech signals, and comparing the absolute value of a voltage level of the detected pitch component with the reference voltage level. The method further comprises a step of separating a speech signal associated with the detected pitch component on the basis of the result of the comparison, and then outputting the separated speech signal.

Preferably, the method includes a first step of splitting each waveform of the speech signals at a predetermined time interval, and a second step of modulating the level of each speech signal waveform obtained at the first step, thereby removing a DC component from the modulated speech signal waveform. The method further includes a third step of detecting a pitch component of each speech signal waveform modulated in level at the second step, a fourth step of comparing the absolute value of a voltage level of the pitch component detected at the third step with the initially set reference voltage level, and a fifth step of selectively outputting each speech signal waveform obtained at the first step on the basis of the result of the comparison performed in the fourth step.

The fifth step preferably comprises the steps of recognizing the speech signal associated with the detected pitch component as a non-sound when the result of the comparison performed at the fourth step corresponds to a first state, while recognizing the speech signal as a voiceless sound when the result of the comparison corresponds to a second state, and outputting the non-sound and voiceless sound, respectively, through separate lines. The method further comprises the step of filtering the non-sound prior to outputting the non-sound during the fifth step, thereby removing a noise component included in the non-sound.

In accordance with another embodiment, the present invention provides an apparatus for discriminating non-sounds and voiceless sounds from speech signals recorded on a tape upon playing back the speech signals at a varied playback speed. The apparatus comprises a waveform splitter for splitting each waveform of the speech signals at a predetermined time interval, and a level modulator for modulating the level of each speech signal waveform obtained by the splitting operation of the waveform splitter, thereby removing a DC component included in the speech signal waveform. The apparatus further comprises a pitch detector for detecting the voltage level of a pitch component of each speech signal waveform modulated in level by the level modulator, a comparator for comparing the absolute value of the voltage level of the pitch component detected by the pitch detector with a reference voltage level that has been initially set, and a switch for selectively outputting each speech signal waveform obtained by the splitting operation of the waveform splitter on the basis of the result of the comparison performed by the comparator.

The reference voltage level is preferably set to be higher than the absolute value of the voltage level of the pitch component of a non-sound detected by the pitch detector, but lower than the absolute value of the voltage level of a voiceless sound detected by the pitch detector. However, the voltage level can be any level which accomplishes the above objective. Also, the switch is preferably controlled to output each speech signal waveform obtained by the splitting operation of the waveform splitter through a first line when the result of the comparison by the comparator corresponds to a first state, while outputting the speech signal waveform through a second line when the result of the comparison corresponds to a second state.

The apparatus further comprises a noise filter connected to a terminal of the switch which is adapted to output a speech signal having a pitch component with a voltage level lower than the reference voltage level. The noise filter filters a noise component of the speech signal waveform output through the terminal of the switch.

BRIEF DESCRIPTION OF THE DRAWINGS

Other objects and aspects of the invention will become apparent from the following description of embodiments with reference to the accompanying drawings, in which.

DETAILED DESCRIPTION OF THE PREFERRED EMBODIMENTS

Figure 1:
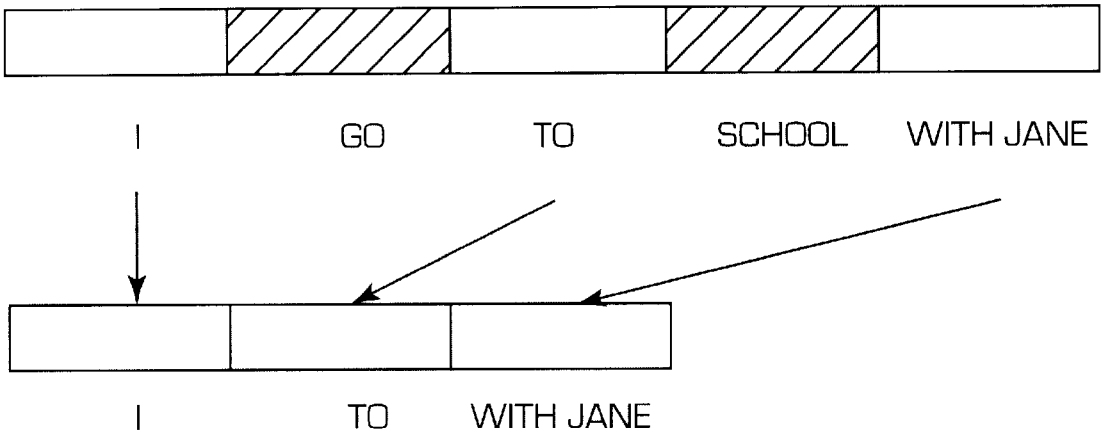
FIG. 1 PRIOR ART
FIG. 1 is a diagram for explaining a conventional speech signal reproduction method.
Figure 2:
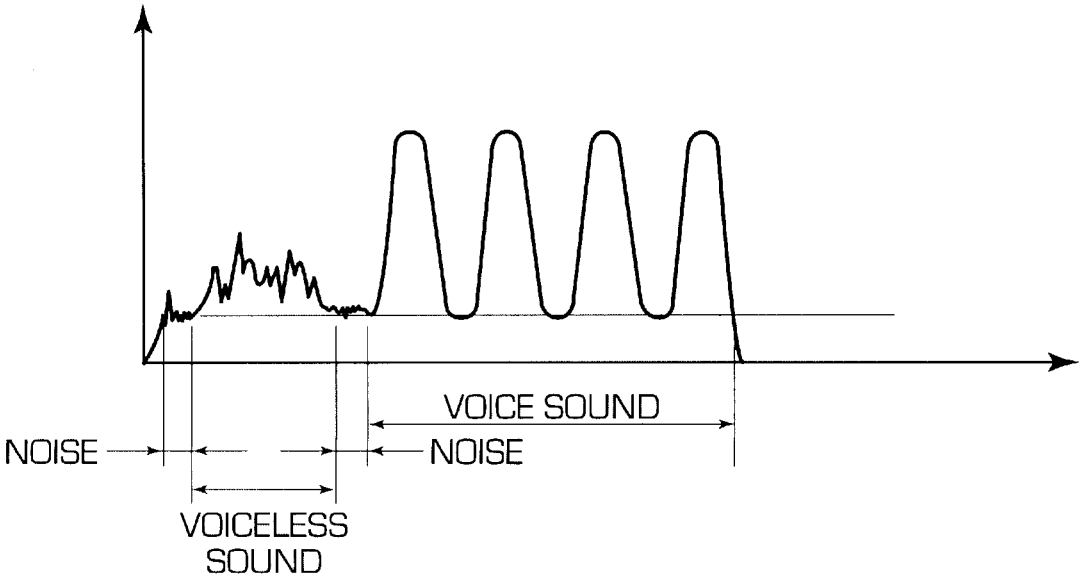
FIG. 2 PRIOR ART
FIG. 2 is a waveform diagram of a typical speech signal.
Figure 3A:
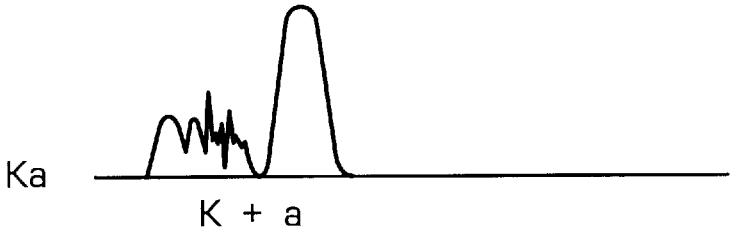
FIG. 3A PRIOR ART
FIGS. 3A–3C are diagrams illustrating waveforms of voiceless sound and voice sound of a speech signal which vary depending on a variation in length of the speech signal.
Figure 3B:
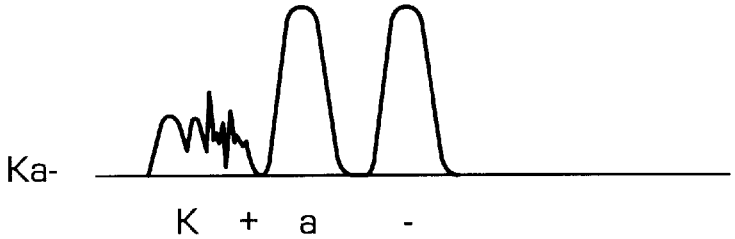
FIG. 3B PRIOR ART
Figure 3C:
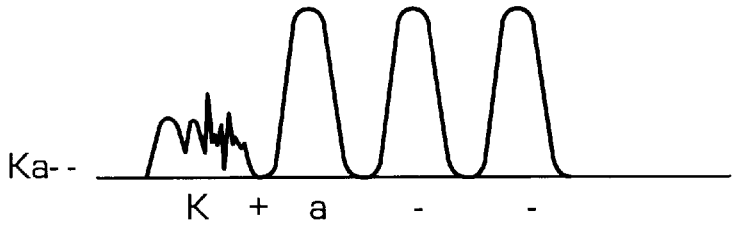
FIG. 3C PRIOR ART
Figure 4A:
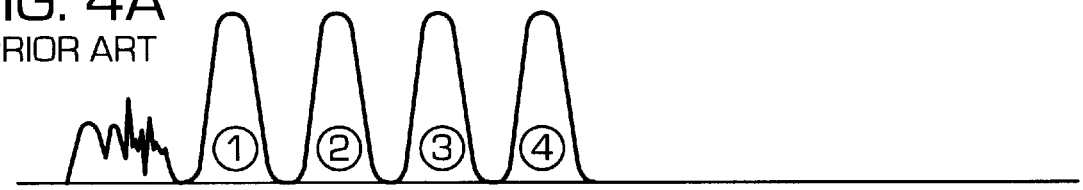
FIG. 4A PRIOR ART
FIGS. 4A–4C are waveform diagrams illustrating how the waveforms of a speech signal are affected during a conventional speed-varied speech signal reproduction method.
Figure 4B:
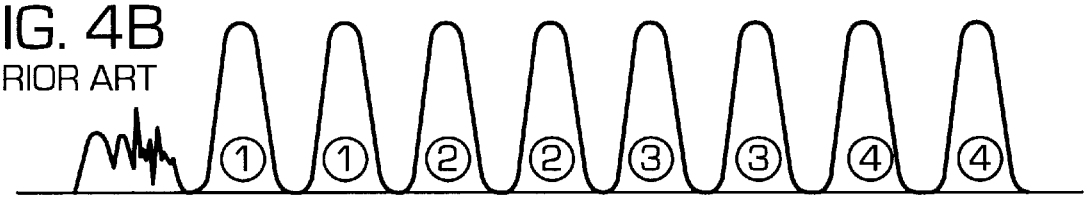
FIG. 4B PRIOR ART
Figure 4C:
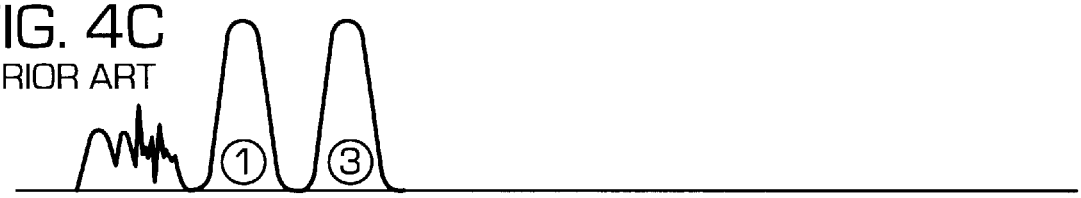
FIG. 4C PRIOR ART
Figure 5:
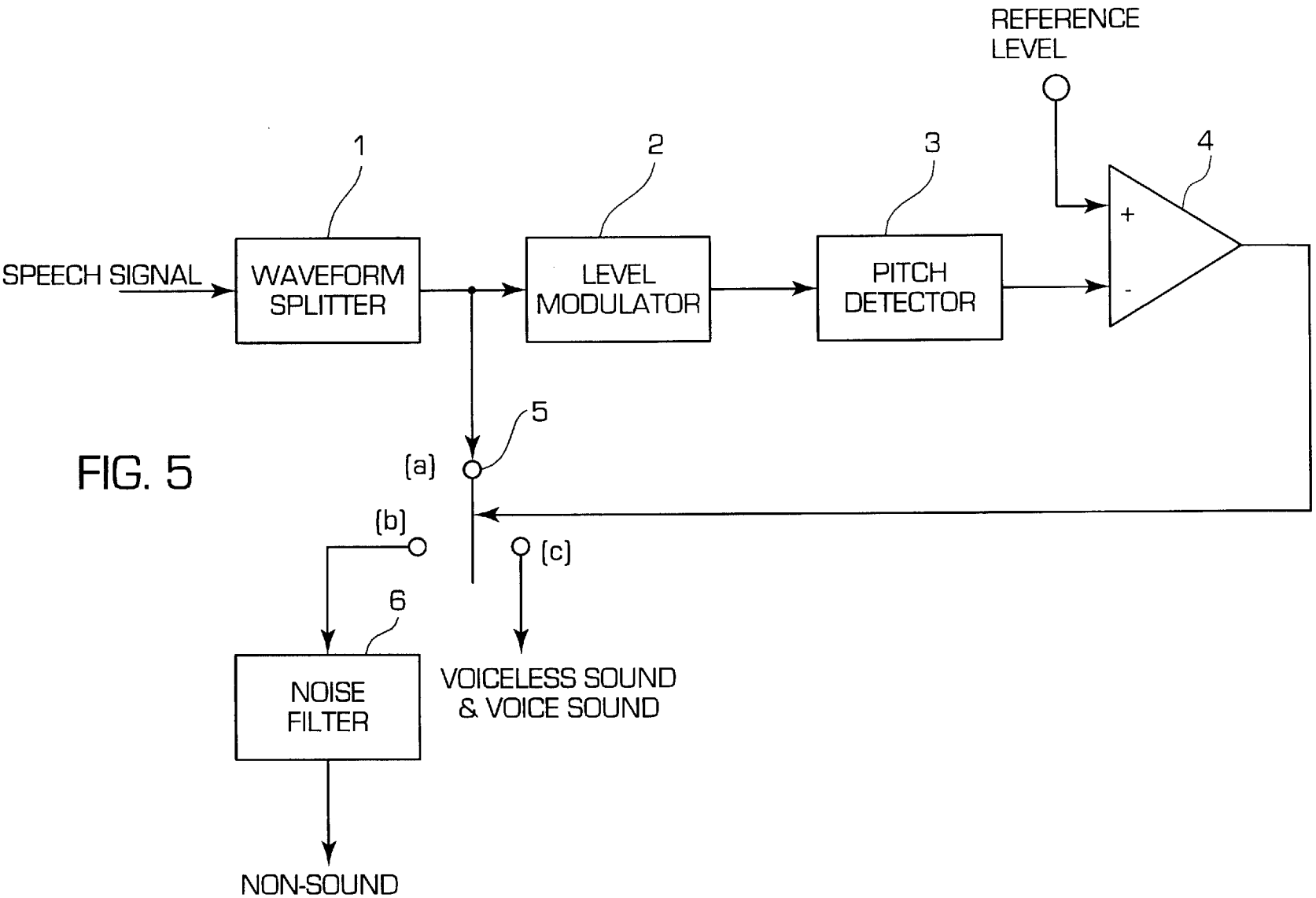
FIG. 5 is a block diagram schematically illustrating an apparatus for discriminating non-sounds and voiceless sound of speech signals in accordance with an embodiment the present invention.

An embodiment of an apparatus for discriminating non-sounds and voiceless sound of speech signals in accordance with the present invention is illustrated in FIG. 5. The apparatus includes a waveform splitter 1 for splitting the waveform of a speech signal detected from a recording medium (not shown) at a desired time interval, a level modulator 2 for modulating the level of each speech signal waveform obtained by the splitting operation of the waveform splitter 1, and a pitch detector 3 for detecting a pitch component of each speech signal waveform modulated in level by the level modulator 2.

The apparatus further includes a comparator which compares the level of the pitch component detected by the pitch detector 3 with a reference level, which is initially set. The apparatus also includes a switch 5 for selectively outputting each speech signal waveform obtained by the splitting operation of the waveform splitter 1 on the basis of the result of the comparison performed by the comparator 4, and a noise filter 6 for filtering a noise component of the speech signal waveform received thereto through the switch 5.

An operation of the apparatus as shown in FIG. 5 will now be described with reference to FIGS. 6A–6F.

Figure 6A:
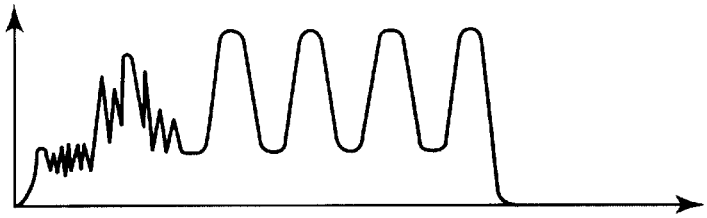
FIGS. 6A–6F are examples of waveform diagrams output from the components of the apparatus shown in FIG. 5.

When a speech signal, as shown in FIG. 6A, is initially applied to the waveform splitter 1 of the apparatus, the waveform splitter 1 splits the received speech signal at a predetermined time interval. Each speech signal waveform split from the speech signal is then modulated in level, without its DC component, by the level modulator 2. The level modulation of the speech signal waveform is performed as expressed by the following equation:

$$V=Vn-V(n-1) \quad (1)$$

where n represents the number of sampling times and is a natural number not less than 1, and V is a voltage level of the speech signal.

Figure 6B:
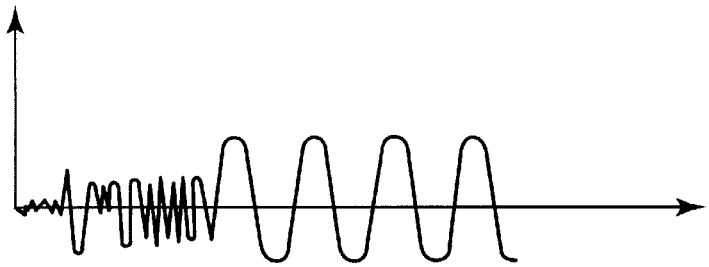

When the difference between each sampling level and a previous sampling level is taken when the value of n is sufficiently large, a modulated waveform, which is substantially similar to the waveform before being level modulated, is output, as shown in FIG. 6B. The level of the speech signal waveform modulated by the level modulator 2 increases or decreases at the same rate as the level of the speech signal waveform before being level modulated.

Figure 6C:
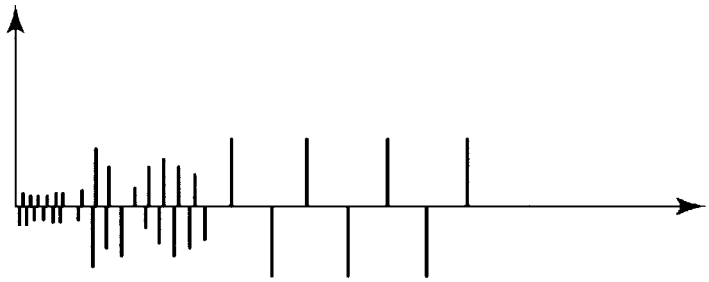

Each speech signal waveform, which has been modulated in level, is then applied to the pitch detector 3 which detects the pitch component of the waveform, as shown in FIG. 6C. The pitch component of the waveform detected by the pitch detector 3 is indicative of the voltage level of the corresponding waveform. The absolute value of this voltage level is then applied to the non-inverting terminal (+) of the comparator 4.

Figure 6D:
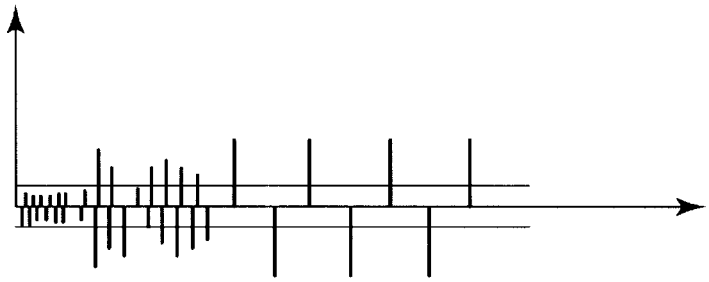
Figure 6E:
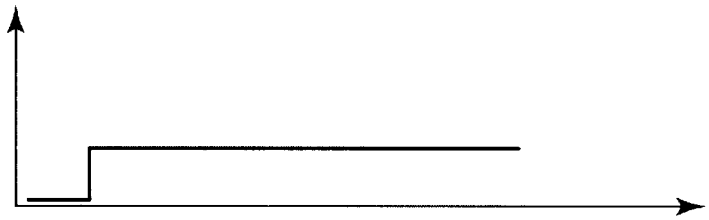

The comparator 4 also receives a reference voltage level at its inverting terminal. As described above, the reference voltage level is preferably set to be higher than the absolute value of the voltage level of the pitch component of a non-sound detected by the pitch detector, but lower than the absolute value of the voltage level of a voiceless sound detected by the pitch detector. The comparator 4 compares the two voltage levels applied thereto, as shown in FIG. 6D, and outputs a control signal which has a logic "high" or "low" state, as shown in FIG. 6E, based on the result of the comparison.

The control signal output from the comparator 4 is applied to the switch 5 to control the switching operation of the switch 5. Since the terminal (a) of the switch 5 is connected to the output terminal of the waveform splitter 1, the speech signal waveform supplied from the waveform splitter 1 to the terminal (a) is selectively output in accordance with the switching state of the switch 5.

For example, when the absolute value of the voltage level of the pitch component detected by the pitch detector 3 is lower than the reference voltage level, which is set at a predetermined value higher than the absolute value of the voltage level of the pitch component of noise, but lower than the absolute value of the voltage level of voiceless sound, the output of the comparator 4 indicates that the corresponding speech signal waveform split by the waveform splitter 1 corresponds to a non-sound which includes a noise component. In this event, the output of the comparator 4 is at a logic "low" level, thereby causing the terminal (a) of the switch 5 to be coupled to the terminal (b). As a result, the speech signal waveform from the waveform splitter 1 is applied to the noise filter 6 through the terminals (a) and (b). The noise filter 6 filters out the noise component and accordingly, only a non-sound component free of the noise component is output.

Figure 6F:
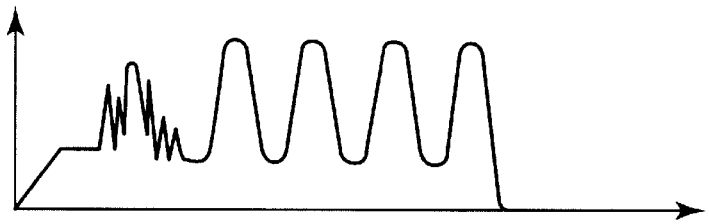

On the other hand, when the absolute value of the voltage level of the pitch component detected by the pitch detector 3 is higher than the reference voltage level, the comparator 4 determines that the corresponding speech signal waveform split by the waveform splitter 1 corresponds to a waveform consisting of a voiceless sound and a voice sound having a voltage level higher than that of the voiceless sound. In this case, the output of the comparator 4 is at a logic "high" level, thereby causing the terminal (a) of the switch 5 to be coupled to the terminal (c). As a result, the speech signal waveform from the waveform splitter 1 is output through the terminals (a) and (b) without passing through the noise filter 6. Accordingly, discrimination and separation of non-sound and voiceless sound can be effectively achieved. The resulting output speech signal is shown in FIG. 6F. It is noted that the smooth rising and horizontal portion of the output speech signal closest to the vertical axis corresponds to the non-sound which has been filtered to remove noise.

As demonstrated above, the present invention provides a method and apparatus for discriminating and separating non-sounds, which include noise, from voiceless sounds present in speech signals. In particular, noise which is included in non-sounds is used to distinguish and thus separate the non-sounds from the voiceless sounds, and the noise can therefore be removed from the non-sounds through a noise filter. Hence, the reproduction of speech signals at a varied play-back speed can be more effectively achieved because it is possible to not only reproduce clearer original sounds, but also, to prevent generation of noise when playing back speech signals at a varied play-back speed.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for discriminating non-sounds and voiceless sounds of speech signals, recorded on a recording medium, from each other when playing back the speech signals at a varied play-back speed, comprising the steps of:

setting a reference voltage level to be a predetermined value between a voltage level corresponding to the non-sounds and a voltage level corresponding to the voiceless sounds;

detecting a pitch component of each waveform of the speech signals;

comparing the absolute value of a voltage level of the detected pitch component with the reference voltage level; and distinguishing a portion of the speech signal associated with the detected pitch component based on the result of the comparing step to determine whether the portion of the speech signal is a non-sound or a voiceless.

2. A method as claimed in claim 1, wherein:

the detecting step comprises the steps of:

(a) splitting each waveform of the speech signals at a predetermined time interval;

(b) modulating the level of each speech signal waveform obtained in step (a), thereby removing a DC component from the modulated speech signal waveform; and (c) detecting a pitch component of each speech signal waveform modulated in level in step (b);

the comparing step comprises the step of:

(d) comparing the absolute value of a voltage level of each said pitch component detected in step (c) with the initially set reference voltage level; and the distinguishing step comprises the step of:

(e) selectively outputting each speech signal waveform obtained at the step (a) on the basis of the result of the comparison peformed in step (d).

3. A method as claimed in claim 2, wherein step (e) comprises the steps of:

recognizing the speech signal associated with the detected pitch component as a non-sound when the result of the comparison performed in step (d) corresponds to a first state, and recognizing the speech signal as a voiceless sound when the result of the comparison corresponds to a second state; and outputting the non-sound and voiceless sound through separate lines, respectively.

4. A method as claimed in claim 3, further comprising the step of:

filtering the non-sound prior to outputting said non-sound in step (e) to remove a noise component included therein.

5. An apparatus for discriminating non-sounds and voiceless sounds of speech signals, recorded on a recording medium, from each other when playing back the speech signals at a varied play-back speed, comprising:

a waveform splitter for splitting each waveform of the speech signals at a predetermined time interval;

a level modulator for modulating the level of each speech signal waveform obtained by the splitting operation of the waveform splitter to remove a DC component included in the speech signal waveform;

a pitch detector for detecting the voltage level of a pitch component of each speech signal waveform modulated in level by the level modulator;

a comparator for comparing the absolute value of the voltage level of the pitch component detected by the pitch detector with a predetermined reference voltage level which is higher than the absolute value of the voltage level of the pitch component of the non-sounds detected by the pitch detector, and lower than the absolute value of the voltage level of the voiceless sounds detected by the pitch detector; and a switch for selectively outputting each speech signal waveform obtained by the splitting operation of the waveform splitter based on the result of the comparison by the comparator.

6. An apparatus as claimed in claim 5, wherein the switch is controlled to output each speech signal waveform obtained by the splitting operation of the waveform splitter through a first line when the result of the comparison by the comparator corresponds to a first state, and to output the speech signal waveform through a second line when the result of the comparison corresponds to a second state.

7. An apparatus as claimed in claim 6, further comprising:

a noise filter connected to a terminal of the switch adapted to output a speech signal having a pitch component with a voltage level lower than the reference voltage level, the noise filter filtering a noise component of the speech signal waveform output through the terminal of the switch.

* * * * *